US009845222B2

(12) United States Patent
Hawtof et al.

(10) Patent No.: US 9,845,222 B2
(45) Date of Patent: Dec. 19, 2017

(54) SPOOL APPARATUS AND METHODS OF WINDING A LENGTH OF CABLE

(71) Applicant: Corning Optical Communications LLC, Hickory, NC (US)

(72) Inventors: Daniel Warren Hawtof, Corning, NY (US); Michael George Shultz, Lowman, NY (US)

(73) Assignee: Corning Optical Communications LLC, Hickory, NC (US)

( * ) Notice: Subject to any disclaimer, the term of this patent is extended or adjusted under 35 U.S.C. 154(b) by 0 days.

(21) Appl. No.: 15/071,768

(22) Filed: Mar. 16, 2016

(65) Prior Publication Data

US 2016/0194177 A1 Jul. 7, 2016

Related U.S. Application Data

(63) Continuation of application No. PCT/US2014/056469, filed on Sep. 19, 2014.

(60) Provisional application No. 61/883,281, filed on Sep. 27, 2013.

(51) Int. Cl.
*B65H 75/14* (2006.01)
*B65H 54/28* (2006.01)

(52) U.S. Cl.
CPC ..... *B65H 75/14* (2013.01); *B65H 54/2863* (2013.01); *B65H 2701/32* (2013.01); *B65H 2701/514* (2013.01)

(58) Field of Classification Search
CPC ..... B65H 75/14; B65H 2701/32; B65H 2701/514; B65H 54/2863
See application file for complete search history.

(56) References Cited

U.S. PATENT DOCUMENTS 2,944,756 A * 7/1960 Wilson ..... B65H 75/14 242/610.4
3,013,378 A * 12/1961 Newton, Jr. ..... B65H 75/00 206/389
3,116,033 A 12/1963 Bock
3,685,644 A * 8/1972 Cothran ..... B65D 85/66 206/408

(Continued)

FOREIGN PATENT DOCUMENTS

DE 4445572 A1 6/1995
EP 1295836 A2 3/2003

OTHER PUBLICATIONS

Patent Cooperation Treaty, International Search Report and Written Opinion for PCT/US2014/056469, dated Dec. 5, 2014, 10 pages.

(Continued)

*Primary Examiner* — William E Dondero
(74) *Attorney, Agent, or Firm* — William D. Doyle

(57) ABSTRACT

A spool apparatus includes a first flange with a first layer of conformable material defining an inner face of the first flange and a second flange with a second layer of conformable material defining an inner face of the second flange. Methods are also provided where a first end winding of a first layer of windings is pressed into the inner face of the first flange such that the first layer of conformable material of the first flange conforms the inner face of the first flange into a shape of a circumferential surface portion of the first end winding.

20 Claims, 5 Drawing Sheets

(56) References Cited

U.S. PATENT DOCUMENTS

| | | | | |
|---|---|---|---|---|
| 3,819,124 | A * | 6/1974 | Marks | G11B 23/037 206/586 |
| 3,951,355 | A | 4/1976 | Morioka et al. | |
| 5,183,217 | A | 2/1993 | Holler et al. | |
| 2008/0156928 | A1 | 7/2008 | Doud et al. | |

OTHER PUBLICATIONS

Final Lead Placement: An Effective Way for Coil Space Utilization. Howard A George. 1982.
Coil Winding Machine Design: An Analysis of Current Practices and Their Effect on Coil Quality. Howard A George. 1978. Coil Winding Int 2 (1), pp. 23-29.
How to Avoid Problems When Winding Perfect Layer Coils. Howard A George. 1977. Insul Circuits 23 (6), pp. 17-21.
Practical Aspects of Perfect Layer Coil Winding. Howard A George. 1976. Insul Circuits 22 (12), pp. 25-29.
Orthocyclic Winding of Magnet Wire Without Interleaving Materials. Howard A George. 1976. Insul Circuits 22 (9), pp. 43-46.
New Developmetns in Coil Winding. Howard A George. 1975. Electronic Packaging and Production 15 (9), pp. 61-62, 65, 67.
Understanding Toroid Coil Winding Machines: How Thery Operate and What They Do. Howard A George. 1974. Insul Circuits 20 (5), pp. 51-57.
Perfect Layering in Coil Winding. Howard A George. 1973. Electronic Packaging and Production 13 (2), pp. 9 P Between p. 50 and 62.

* cited by examiner

SPOOL APPARATUS AND METHODS OF WINDING A LENGTH OF CABLE

RELATED APPLICATION

This application is a continuation of International Application No. PCT/US14/56469, filed on Sep. 9, 2014, which claims the benefit of priority under 35 U.S.C. §119 to U.S. Provisional Application Ser. No. 61/883,281 filed on Sep. 27, 2013, the contents of which are relied upon and incorporated herein by reference in their entirety.

BACKGROUND

Field of the Invention

The present invention relates generally to spool apparatus and methods of winding a length of cable and, more particularly, to spool apparatus including a flange with a layer of conformable material defining an inner face of the flange and methods of winding with the spool apparatus.

Technical Background

Conventional spools are known to include rigid flanges mounted to a drum of the spool. Methods of winding cable with the spool include winding the cable along multiple layers of windings wherein end windings of the layers of windings engage the rigid surfaces of the flanges. Such configurations are undesirable since winding of the cable from a first direction creating a first layer of windings to a second direction creating a second layer of stacked windings is triggered automatically when the cable encounters the rigid flange, despite whatever cable geometry of the underlying layer of windings is presented. Such conventional winding leads to undesired gaps between cable windings and/or undesired overlaps of cables along the layer of windings. As such, current spools with conventional rigid flanges do not provide for reversing the direction of winding at a selected position corresponding to a proper underlying cable layer geometry where the next winding of the stacked layer can easily fall into the underlying groove defined between underlying windings.

SUMMARY

In a first aspect of the disclosure, a spool apparatus is configured to wind a length of cable. The spool apparatus comprises a drum extending along a central axis of the spool apparatus. The spool apparatus further includes a first flange mounted with respect to a first axial end portion of the drum. The first flange includes a first layer of conformable material defining an inner face of the first flange. The spool apparatus further includes a second flange mounted with respect to a second axial end portion of the drum. The second flange includes a second layer of conformable material defining an inner face of the second flange. A cylindrical storage area is defined between the inner face of the first flange, the inner face of the second flange and an outer peripheral surface of the drum. The first layer of conformable material is configured to conform the inner face of the first flange into a shape of a circumferential surface portion of a first end winding of cable wound within the cylindrical storage area in response to the first end winding of cable being pressed against the inner face of the first flange. The second layer of conformable material is configured to conform the inner face of the second flange into a shape of a circumferential surface portion of a second end winding of cable wound within the cylindrical storage area in response to the second end winding of cable being pressed against the inner face of the second flange.

In one example of the first aspect, the first layer of conformable material is configured to apply an inner axial force component to the first end winding of cable in a first direction of the central axis, and the second layer of conformable material is configured to apply an inner axial force component to the second end winding in second axial direction of the central axis that is opposite to the first axial direction.

In another example of the first aspect, each layer of conformable material is substantially resilient.

In still another example of the first aspect, each layer of conformable material has a compression deflection of 25% within a range of from about 34 kPa to about 345 kPa.

In yet another example of the first aspect, an outer peripheral inner edge of the conformable material comprises an outer beveled portion.

In a further example of the first aspect, the first flange comprises a first layer of substantially rigid material supporting the first layer of conformable material and the second flange comprises a second layer of substantially rigid material supporting the second layer of conformable material. For example, each layer of substantially rigid material includes an inner major surface facing an inward direction toward the cylindrical storage area. The first layer of conformable material includes an outer surface mounted to the inner major surface of the first layer of substantially rigid material. The second layer of conformable material includes an outer surface mounted to the inner major surface of the second layer of substantially rigid material.

In another example of the first aspect, a winding device is configured to permit winding of the length of cable on the outer peripheral surface of the drum in a first axial direction along the central axis to produce a first layer of windings, and further configured to cause the length of cable to begin winding in a second axial direction to produce a second layer of windings stacked on the first layer of windings in response to a first end winding of the first layer of windings reaching a selected position. For example, the winding device comprises a sensor configured to determine when the first end winding of the first layer of windings reaches the selected position.

The first aspect of the disclosure can be provided alone or in combination with one or more examples of the first aspect discussed above.

In a second aspect of the disclosure a spool of wound cable comprises a drum extending along a central axis of the spool of wound cable. The spool of wound cable further comprises a first flange mounted with respect to a first axial end portion of the drum. The first flange includes a first layer of conformable material defining an inner face of the first flange. The spool of wound cable further includes a second flange mounted with respect to a second axial end portion of the drum. The second flange includes a second layer of conformable material defining an inner face of the second flange. A cylindrical storage area is defined between the inner face of the first flange, the inner face of the second flange and an outer peripheral surface of the drum. A length of cable is wound within the cylindrical storage area to include at least one layer of windings extending between the first flange and the second flange. Each layer of windings includes a first end winding with the first layer of conformable material conforming the inner face of the first flange into a shape of a circumferential surface portion of at least one first end winding of the at least one layer of windings in response to the at least one first end winding being pressed against the inner face of the first flange. Each layer of windings includes a second end winding with the second layer of conformable material conforming the inner face of the second flange into a shape of a circumferential surface portion of at least one second end winding of the at least one layer of windings in response to the at least one second end winding being pressed against the inner face of the second flange.

In one example of the second aspect, the at least one layer of windings includes a plurality of stacked layers of windings with the first layer of conformable material conforming the inner face of the first flange into the shape of the circumferential surface portion of a plurality of first end windings of the plurality of stacked layers of windings in response to the plurality of first end windings being pressed against the inner face of the first flange. The second layer of conformable material conforms the inner face of the second flange into the shape of the circumferential surface portion of a plurality of second end windings of the plurality of stacked layers of windings in response to the plurality of second end windings being pressed against the inner face of the second flange.

In another example of the second aspect, the first layer of conformable material applies a first inner axial force component to the at least one first end winding in a first direction of the central axis while the second layer of conformable material applies a second inner axial force component to the at least one second end winding in a second direction of the central axis opposite to the first direction such that the at least one first end winding and the at least one second end winding are biased towards one another.

In yet another example of the second aspect, the first flange comprises a first layer of substantially rigid material supporting the first layer of conformable material and the second flange comprises a second layer of substantially rigid material supporting the second layer of conformable material. In one example, the first layer of substantially rigid material includes an inner major surface facing the cylindrical storage area, and the first layer of conformable material includes an outer surface mounted to the inner major surface, and the second layer of substantially rigid material includes an inner major surface facing the cylindrical storage area, and the second layer of conformable material includes an outer surface mounted to the inner major surface. In another example, the length of cable includes a diameter taken along a cross-section substantially perpendicular to an elongated axis of the cable, each layer of conformable material includes a thickness defined between the outer surface of the corresponding layer of conformable material and the inner face of the first flange, and the thickness of each layer of conformable material is less than or equal to about 70% of the diameter of the cable.

The second aspect of the disclosure can be provided alone or in combination with one or more examples of the second aspect discussed above.

In a third aspect, a method of winding a length of cable comprises the step of winding the length of cable onto an outer peripheral surface of a drum of a spool in a first axial direction to produce a first layer of windings. Winding the cable in the first axial direction continues to a selected position where a first end winding of the first layer of windings is pressed into an inner face of a first flange of the spool such that a first layer of conformable material of the first flange conforms the inner face of the first flange into a shape of a circumferential surface portion of the first end winding. The method then includes the step of winding the length of cable in a second axial direction opposite the first axial direction to produce a second layer of windings stacked on the first layer of windings.

In one example of the third aspect, the step of winding the cable provides a plurality of stacked layers of windings including the first layer and the second layer of windings. Each layer of stacked windings includes a first end winding, and the first layer of conformable material conforms the inner face of the first flange into a shape of the circumferential surface portion defined by a plurality of first end windings of the plurality of stacked layers of windings in response to the plurality of first end windings pressing against the inner face of the first flange. Each layer of stacked windings includes a second end winding, and a second layer of conformable material of a second flange of the spool conforms an inner face of the second flange into a shape of the circumferential surface portion defined by a plurality of second end windings of the plurality of stacked layers of windings in response to the plurality of second end windings pressing against the inner face of the second flange. In one example, the first layer of conformable material applies a first inner axial force component to each of the plurality of first end windings in a first axial direction while the second layer of conformable material applies a second inner axial force component to each of the plurality of second end windings in a second axial direction opposite to the first axial direction.

In yet another example of the third aspect, the method comprises the step of operating a winding device to begin winding the length of cable in the second axial direction once the first layer of windings reaches the selected position. For example, the method can include the step of determining the selected position based on feedback from the winding device.

The third aspect of the disclosure can be provided alone or in combination with one or more examples of the third aspect discussed above.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION

Figure 1:
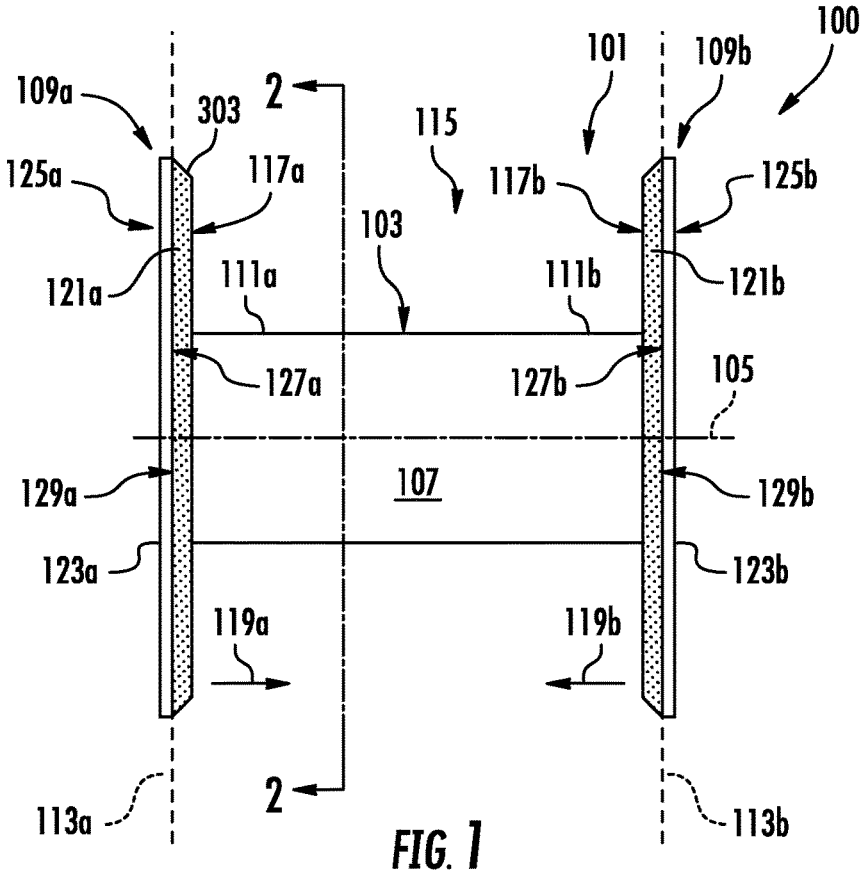
FIG. 1 is a front view of a spool of a spool apparatus configured to store a length of wound cable in accordance with example aspects of the disclosure.

The present invention will now be described more fully hereinafter with reference to the accompanying drawings in which example embodiments of the invention are shown. Whenever possible, the same reference numerals are used throughout the drawings to refer to the same or like parts. However, this invention may be embodied in many different forms and should not be construed as limited to the embodiments set forth herein. These example embodiments are provided so that this disclosure will be both thorough and complete, and will fully convey the scope of the invention to those skilled in the art.

Figure 2:
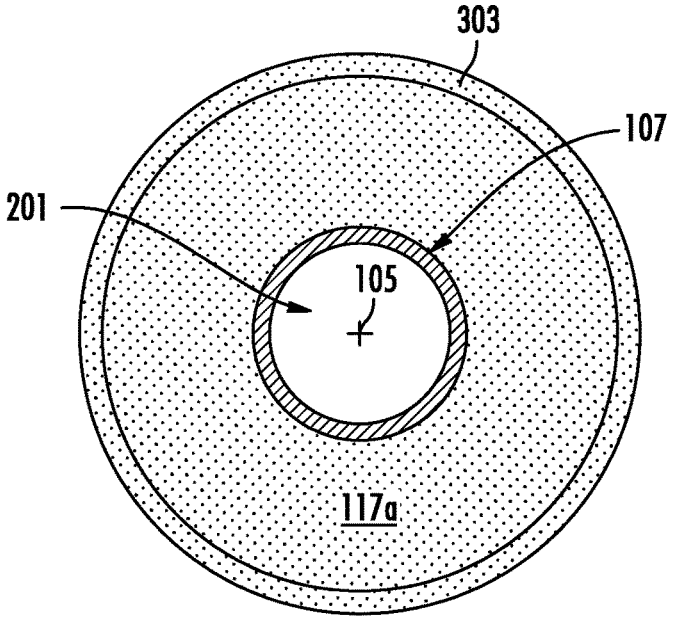
FIG. 2 is a cross-sectional view of the spool along line 2-2 of FIG. 1.
Figure 8:
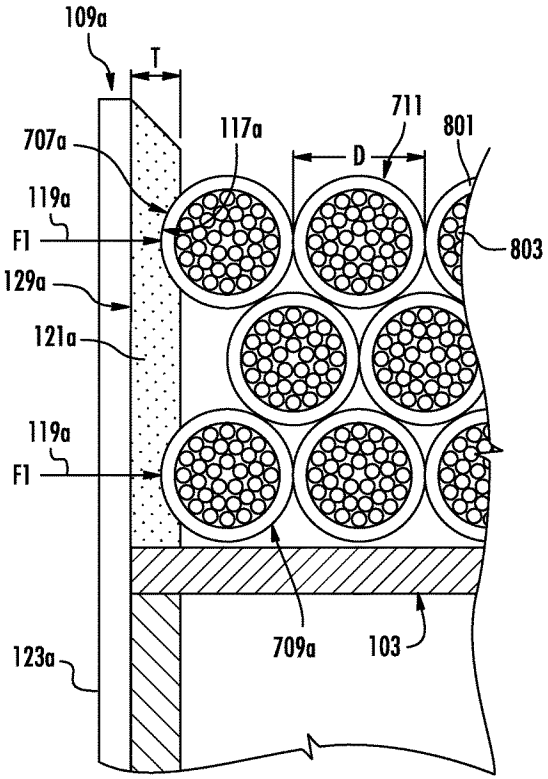
FIG. 8 is an enlarged view of portions of FIG. 7 illustrating a first layer of conformable material of a first flange conforming an inner face of the first flange into a shape of a circumferential surface portion of first end windings of a plurality of stacked layers of windings.

By way of illustration purposes, FIG. 1 illustrates a spool 101 of a spool apparatus 100 configured to store a length of wound cable 711. As shown in FIG. 8, in one example, the cable can comprise an outer jacket 801 protecting a plurality of optical fibers 803 that may be bundled together in a single elongated cable 711 illustrated in FIG. 8. The spool 101 includes a drum 103 extending along a central axis 105 of the spool 101. In one example, the central axis 105 of the spool can comprise a symmetrical axis of the drum 103. For example, as shown in FIG. 2, the central axis 105 can comprise the symmetric axis of the drum 103. As shown in FIG. 2, the drum can comprise a hollow interior area 201 configured to reduce the weight of the spool 101 while providing the drum 103 with sufficient structural integrity to support a length of cable wound on the drum.

The drum 103 can further include an outer peripheral surface 107 that may comprise various shapes. For example, as shown in FIGS. 1 and 2, the outer peripheral surface 107 of the drum 103 can comprise a circular cylindrical surface. As shown in FIG. 2, the circular cylindrical surface of the outer peripheral surface 107 can be represented by the circular profile of the outer peripheral surface 107 taken along a cross-sectional plane that is perpendicular to the central axis 105 of the spool 101. Although not shown, the outer peripheral surface may comprise other cross-sectional profile shapes such as elliptical, polygonal or other shape configuration.

Figure 7:
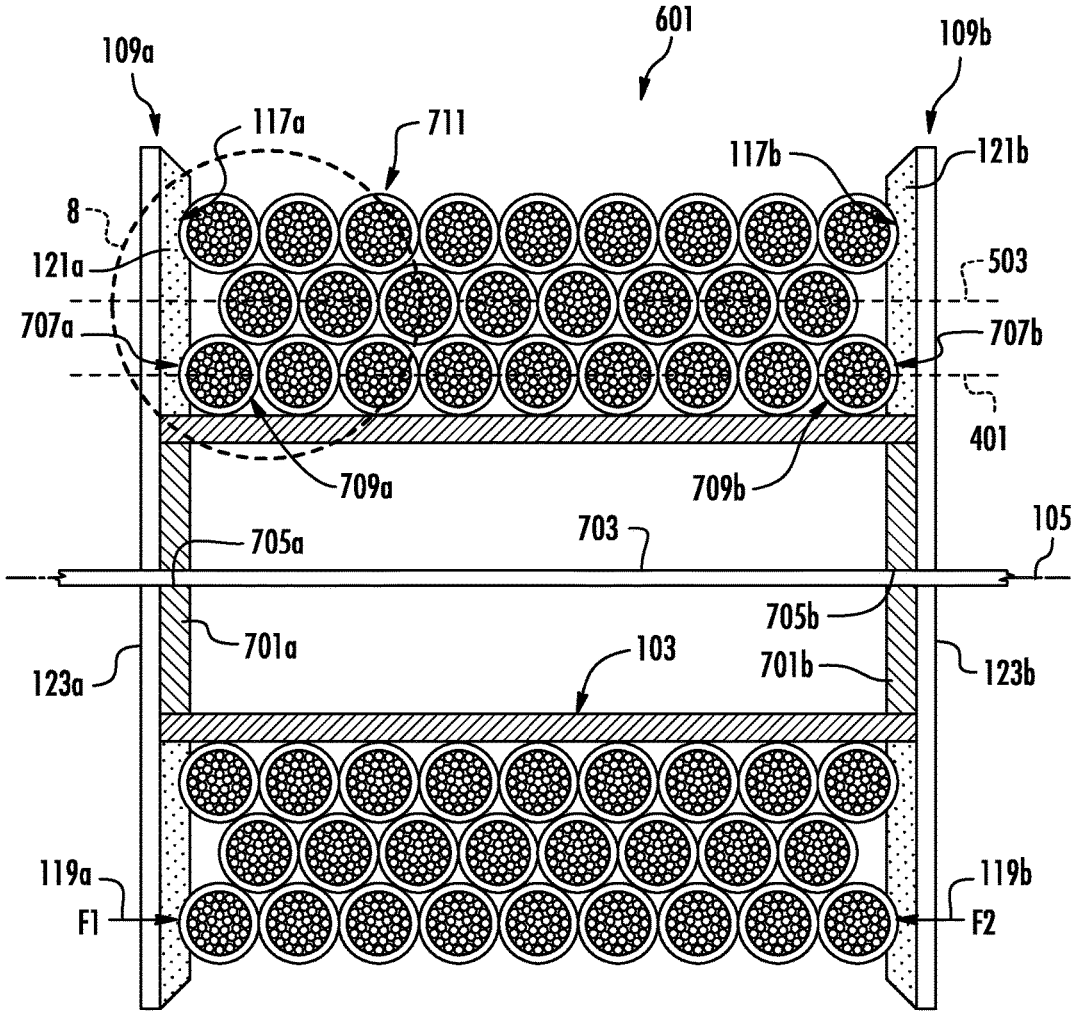
FIG. 7 is a cross-sectional view of the spool of wound cable along line 7-7 of FIG. 6.

As shown in FIG. 7, if the drum provided with a hollow configuration, the drum 103 may optionally include end support caps 701*a*, 701*b* mounted with respect to the otherwise open ends of the hollow drum 103. The end support caps 701*a*, 701*b*, if provided, can help support the drum 103 to provide further structural integrity. The optional end support caps 701*a*, 701*b* may also act as a support structure for the spool 101. For instance, in examples, where the spool 101 comprises a rotational spool apparatus, the end support caps 701*a*, 701*b* may provide a rotational support structure to facilitate rotation of the spool 101 about the central axis 105 of the spool 101. Indeed, in one illustrative example, an axle 703 may extend through corresponding openings 705*a*, 705*b* of the optional end support caps 701*a*, 701*b* to allow relative rotation of the spool 101 with respect to the axle 703. As discussed below with respect to FIGS. 3-5, the spool 101 may be rotated along rotation direction "R" about the central axis 105 to wind the cable 711 onto the spool.

Referring back to FIG. 1, the spool 101 further includes a first flange 109*a* mounted with respect to a first axial end portion 111*a* of the drum 103. The spool 101 also includes a second flange 109*b* mounted with respect to a second axial end portion 111*b* of the drum 103. As shown, the first flange 109*a* and second flange 109*b* may be substantially identical to one another although different configurations may be provided in further examples. As shown, the first and second flanges 109*a*, 109*b* each extend along respective flange planes 113*a*, 113*b*. As shown, the flange planes are substantially flat although the flange planes may have a curved shape in further examples. For instance, the flanged planes may comprise curved planes with inwardly convex surfaces that face one another to allow the peripheral ends of the flanges to flare outwardly to facilitate reception and/or alignment of coils of cable being wound onto the spool apparatus. Still further, as illustrated the flange planes 113*a*, 113*b* can extend substantially perpendicular to the central axis 105. Moreover, the flange planes 113*a*, 113*b* can also extend substantially perpendicular to the outer peripheral surface 107 of the drum 103 although the flange planes 113*a*, 113*b* may extend at other angles relative to the outer peripheral surface 107 in further examples. In one example, while a substantially perpendicular configuration may be desired, in practice, the substantially perpendicular nature may not be achieved or may be lost by damage over time. Moreover, in further examples, the outer peripheral surface may be tapered along the central axis 105. In some examples, the diameter of the central portion of the drum 103 may be less than a diameter at the first and second axial end portions 111*a*, 111*b* of the drum 103. In such examples, the flange planes 113*a*, 113*b* may be substantially perpendicular to the central axis 105 while still being at an obtuse inner angle with respect to the outer peripheral surface at the first and second axial end portions of the drum.

As shown in FIG. 1, the first flange 109*a* includes an inner face 117*a* that faces an inward direction 119*a* toward a cylindrical storage area 115 of the spool 101. Likewise, the second flange 109*b* also includes an inner face 117*b* that faces an inward direction 119*b* toward the cylindrical storage area 115. As shown, in some examples, the inward directions 119*a*, 119*b* are substantially opposite one another and both extend along the central axis 105 although other orientations may be provided in further examples. Each inner face 117*a*, 117*b* of the first and second flange 109*a*, 109*b* are designed to apply a reaction force against respective end windings of a cable wound on the spool 101 to provide lateral support to the layers of windings.

As shown in FIG. 1, the cylindrical storage area 115 is defined between the inner face 117*a* of the first flange 109*a*, the inner face 117*b* of the second flange 109*b* and the outer peripheral surface 107 of the drum 103. As discussed more fully below, the cylindrical storage area allows layers of windings to be stacked relative to one another to provide efficient storage of a length of cable wound on the spool.

The first flange 109*a* and the second flange 109*b* are provided with a layer of conformable material defining an inner face of the respective flange. The figures illustrate both flanges 109*a*, 109*b* including respective layers 121*a*, 121*b* of conformable material although only one of the flanges may comprise a layer of conformable material in further examples. In the illustrated example, the first flange 109*a* includes a first layer 121*a* of conformable material defining the inner face 117*a* of the first flange 109*a*. The second flange 109*b* likewise includes a second layer 121*b* of conformable material defining the inner face 117*b* of the second flange 109*b*.

As shown in FIGS. 7 and 8, the first layer 121*a* of conformable material is configured to conform the inner face 117*a* of the first flange 109*a* into a shape of a circumferential surface portion 707*a* of a first end winding 709*a* of cable 711 stored within the cylindrical storage area 115 in response to the first end winding 709*a* of cable 711 being pressed against the inner face 117*a* of the first flange 109*a*. Likewise, as also shown in FIG. 7, the second layer 121*b* of conformable material is configured to conform the inner face 117*b* of the second flange 109*b* into a shape of a circumferential surface portion 707*b* of a second end winding 709*b* of cable 711 stored within the cylindrical storage area 115 in response to the second end winding 709*b* of cable 711 being pressed against the inner face 117*b* of the second flange 109*b*. FIGS. 7 and 8 illustrate examples where all of the conformed portions of the inner faces engage the corresponding circumferential surface portion of the cable. Although not shown, in other examples, only part of the conformed portion of the inner face engages the corresponding circumferential surface portion of the cable. For instance, in some examples, a central area of the corresponding conformed portion may engage the corresponding circumferential surface portion of the cable while outer areas of the conformed portion may not engage the cable.

The layer of conformable material, such as the first and second layer 121*a*, 121*b* of conformable material can be configured to apply an inner axial force component to the respective end winding of cable in a direction of the central axis 105. For example, as shown in FIG. 7, the first layer 121*a* of conformable material can be configured to apply an inner axial force component F1 by way of the inner face 117*a* to the first end winding 709*a* in the inward direction 119*a* of the central axis 105 toward the cylindrical storage area 115 of the spool 101. Likewise, the second layer 121*b* of conformable material can be configured to apply an inner axial force component F2 by way of the inner face 117*b* to the second end winding 709*b* in the inward direction 119*b* of the central axis 105 toward the cylindrical storage area 115 of the spool 101. In some examples the inner face can apply a force normal to the circumferential surface portion at all locations where the inner face engages in the circumferential surface portion. In such examples, the normal force may still include an inner axial force component that extends in an inward direction of the central axis. As such, the first end winding 709*a* and the second end winding 709*b* can be biased towards one another. In some examples, biasing the end windings toward one another can help form a compact layer of windings with little, if any gap, between the windings. In further examples, biasing the end windings toward one another can help prevent shifting of the windings relative to one another to create undesirable gaps between the windings.

Various materials may be used to provide the layer of conformable material. For instance, various materials may be incorporated such that the first layer and second layer of conformable material are substantially flexible and resilient. As such, in some examples, the layer of conformable material may be capable of at least partially or entirely returning to its original shape after conforming to a shape of the circumferential surface portion of the end winding. Due to the resiliency of the conformable material, the conformable material may apply an axial force component to the cable due to the conformable material attempting to elastically return, or at least partially return, to its original shape.

Providing a resilient conformable material can also allow the spool apparatus to be recycled for subsequent use with a different cable that may have different dimensions. In one example, the resilient conformable material temporarily elastically deforms under pressure to allow the inner face to conform to the shape of the circumferential surface portion of the end winding. Still further, the resiliency of the conformable layer allows a reaction force comprising the above-referenced inner axial force to be applied to the end winding as the conformable material attempts to elastically return (e.g., partially or entirely) to its original shape.

In one example, the first and second layer of conformable material may comprise rubber, foam (e.g., foam rubber), or other materials or combinations of such materials. While open cell foam may be incorporated in some examples, closed cell foam may be provided to help resist liquids or other contaminants from loading the conformable material layer. In further examples, the layer of conformable material may be encapsulated or otherwise encased in a protective layer to avoid contamination from liquids or other debris. For instance, a layer of flexible plastic may encapsulate otherwise outer exposed portions of the conformable material that may otherwise be infiltrated by environmental contaminants.

As shown in the figures, the layer of conformable material may comprise a single layer of conformable material although laminated conformable materials may be provided in further examples. For example, the layer of conformable material may comprise a composite of multiple sub-layers of material integrated together as a laminate layer of conformable material.

In just some examples, the conformable material may have a density of from about 1 $lb/ft^3$ (16 $kg/m^3$) to about 10 $lb/ft^3$ (160 $kg/m^3$), such as from about 2 $lb/ft^3$(32 $kg/m^3$) to about 5 $lb/ft^3$ (80 $kg/m^3$).

In further examples, in addition or alternatively to the density of the material discussed above, the conformable material may have a compression deflection of 25% within various ranges. A compression deflection of 25% is the amount of pressure required to compress the conformable material by 25%. For example, referring to FIG. 8, the compression deflection of 25% of the first layer 121*a* of conformable material would be the pressure resulting in compression of the material such that the thickness "T" of the first layer 121*a* is reduced by 25%. In some examples, the layers of conformable material may have a compression defection of 25% within a pressure range of from about 5 psi (34 kPa) to about 30 psi (207 kPa), such as from about 9 psi (62 kPa) to about 20 psi (138 kPa).

In still further examples, in addition or alternative to one or both the density and compression deflection properties discussed above, the conformable material may have a compression set within various ranges. The compression set is a measure of the permanent deformation of the conformable material when the force is removed. The compression set can be calculated by an experiment where a 1.8 kN force is applied to the conformable material for a set temperature and time. Then the compression set can then be defined as the percentage of original thickness that is achieved after the force has been removed for 30 minutes. In such an example, the compression set can be calculated with the equation $100*(T_o-T_f)/T_o$ wherein ($T_o$) is the original thickness of the layer of conformable material and ($T_f$) is the final thickness of the layer of conformable material after testing.

In another example, compression set can be calculated by compressing the conformable material to 25% of its original thickness for a set temperature and time. The compression set can then be defined as the percentage of original thickness that is achieved after the force has been removed for 30 minutes. In such an example, the compression set can be calculated with the original thickness ($T_o$) of the layer of conformable material, the final thickness ($T_f$) after testing and the thickness ($T_t$) of the layer of conformable material as $100*(T_o-T_f)/(T_o-T_t)$. In one example, the compression set achieved by one or both of the tests set forth above can be within a range of from about 0% to about 40% such as from about 10% to about 30% such as from about 15% to about 25%.

Some example layers of conformable material can be fabricated, for example, from viscoelastic polyurethane foam, low-resilience polyurethane foam (LRPu), Sorbothane® foam available from Sorbothane, Inc of Kent, Ohio, Neoprene, polychloroprene, polyether foam available from Foamex Innovations, Sinomax® foam available from Sinomax, foam available under product numbers XLP10022, XLP100180 and XLP10019 available from the Nott Company located in Princeton Minn., foam available from NCFI Polyurethanes, foam available from Domfoam International, or other foams.

The properties of example materials are listed below.

| | Example 1 | Example 2 | Example 3 |
|---|---|---|---|
| Density | 2 lb/ft$^3$ (32 kg/m$^3$) | 2.8 lb/ft$^3$ (45 kg/m$^3$) | 3-5 lb/ft$^3$ (48-80 kg/m$^3$) |
| Compression Deflection, 25% | 9 psi (62 kPa) | 9.4 psi (65 kPa) | 20 psi (138 kPa) |
| Compression Set | 20% | 19% | 25% |

For example, in some embodiments the density of the foam is at least about 1.5 lb/ft$^3$ to provide sufficient resistance to compression for purposes disclosed herein, and/or the density is no more than 8 lb/ft$^3$ so as to provide sufficient flexibility. In some embodiments, the compression pressure for 25% deflection of the foam is at least 5 psi and/or no more than 40 psi, such as when compressing at a rate of 5% per second.

Optionally, the first flange and/or the second flange may comprise a layer of substantially rigid material. For example, as shown in FIG. 1, the first flange 109*a* may include a first layer 123*a* of substantially rigid material and the second flange 109*b* may include a second layer 123*b* of substantially rigid material. The corresponding layer of rigid material may provide support for the layer of conformable material. For example, as shown in FIG. 1, the first layer 123*a* of substantially rigid material supports the first layer 121*a* of conformable material while the second layer 123*b* of substantially rigid material supports the second layer 121*b* of conformable material. Each layer of conformable material may be a self-supporting material without a corresponding layer of substantially rigid material. However, providing the layer of substantially rigid material can help increase the reaction force that may be applied by the conformable material and help the conformable material maintain the structural support that may be desired to help laterally support the end windings of the cable.

Substantially rigid material of the layer of substantially rigid material can include materials with a shear modulus of greater than or equal to 10 GPa. For example, the material can comprise wood having a shear modulus of 13 GPa, aluminum with a shear modulus of at least 24 GPa, steel with a shear modulus of 77 GPa or other substantially rigid materials.

Moreover, the conformable material of the layer of conformable material may have a shear modulus of less than about 0.1 GPa. For example, the conformable material may have a shear modulus of rubber having a shear modulus of 0.0003 GPa. In further examples, the conformable material and the rigid material may be selected such that the shear modulus of the conformable material is an order of 4-5 magnitude less than the shear modulus of the substantially rigid material. For example, if the rigid material comprises wood (G=13 GPa) and the conformable material comprises rubber (G=0.0003 GPa), the conformable material is an order of magnitude of between 4-5 less than the rigid material.

As shown in the example embodiment, the first layer 123*a* of substantially rigid material includes a thickness defined between an outer major surface 125*a* and an inner major surface 127*a*. The inner major surface 127*a* faces the inward direction 119*a* toward the cylindrical storage area 115. The first layer 121*a* of conformable material includes an outer surface 129*a* mounted to the inner major surface 127*a* of the first layer 123*a* of substantially rigid material. Likewise, the second layer 123*b* of substantially rigid material includes a thickness defined between an outer major surface 125*b* and an inner major surface 127*b*. The inner major surface 127*b* faces the inward direction 119*b* toward the cylindrical storage area 115. The second layer 121*b* of conformable material includes an outer surface 129*b* mounted to the inner major surface 127*b* of the second layer 123*b* of substantially rigid material. In one example, the layer of conformable material is mounted by an adhesive to the layer of substantially rigid material although fastening mechanisms may be provided in further examples. For instance, an existing spool may be retrofitted to include the layers of conformable material that may be mounted, for example, by adhesive to the existing substantially rigid flanges of the spool.

A method of winding a length of cable 711 will now be described. The method includes the step of providing the spool apparatus 100 with the spool 101 including the drum 103 extending along the central axis 105 of the spool apparatus. The first flange 109*a* is mounted with respect to the first axial end portion 111*a* of the drum and the second flange 109*b* is mounted with respect to the second axial end portion 111*b* of the drum 103. The spool apparatus includes the cylindrical storage area 115 defined between the inner face 117*a* of the first flange 109*a*, the inner face 117*b* of the second flange 109*b* and the outer peripheral surface 107 of the drum 103. As discussed above, the first flange 109*a* includes the first layer 121*a* of conformable material defining the inner face 117*a* of the first flange 109*a* and the second flange 109*b* includes the second layer 121*b* of conformable material defining the inner face 117*b* of the second flange 109*b*.

Figure 3:
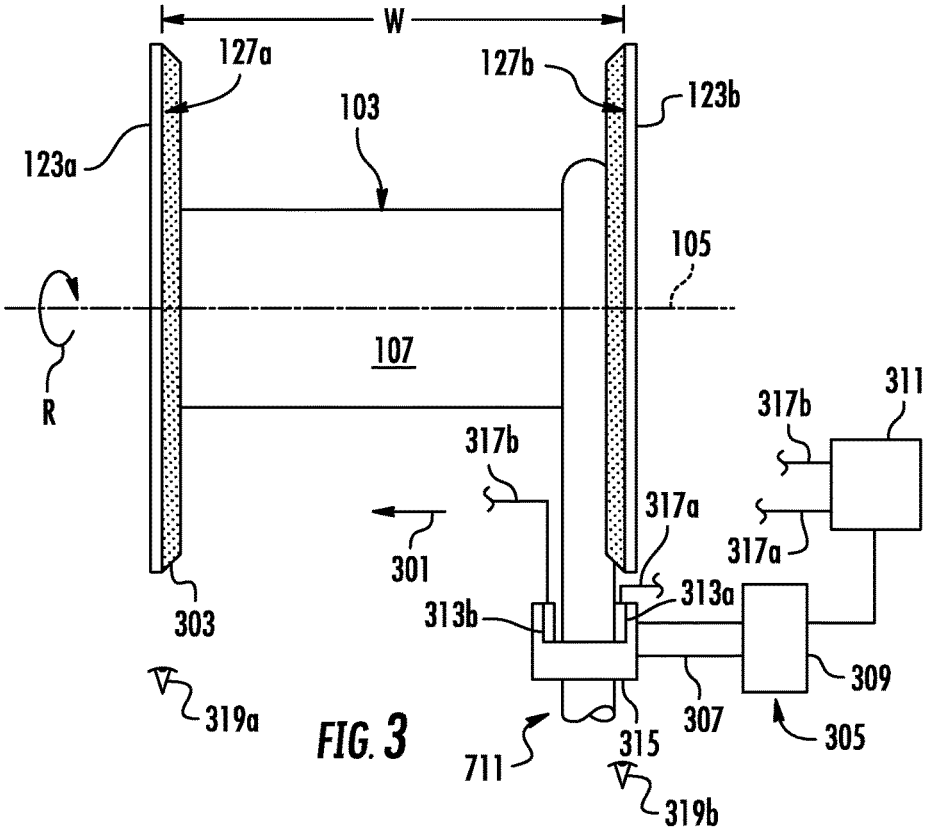
FIG. 3 illustrates a length of cable being wound onto an outer peripheral surface of a drum of the spool with a winding device of the spool apparatus.
Figure 4:
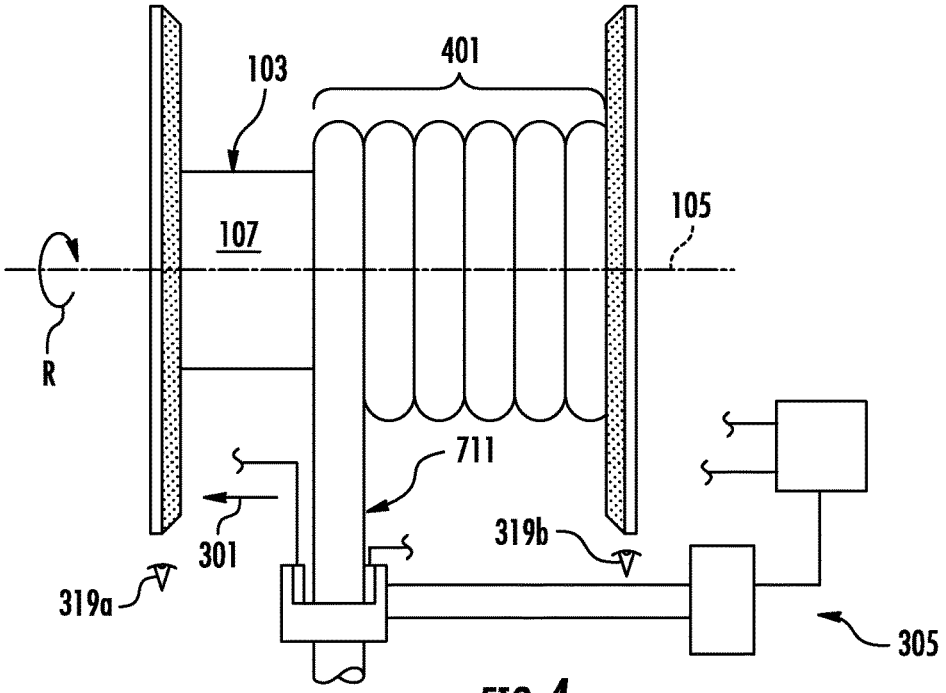
FIG. 4 illustrates the length of cable being further wound onto the outer peripheral surface of the drum with the winding device in a first axial direction along the central axis to produce a first layer of windings.
Figure 5:
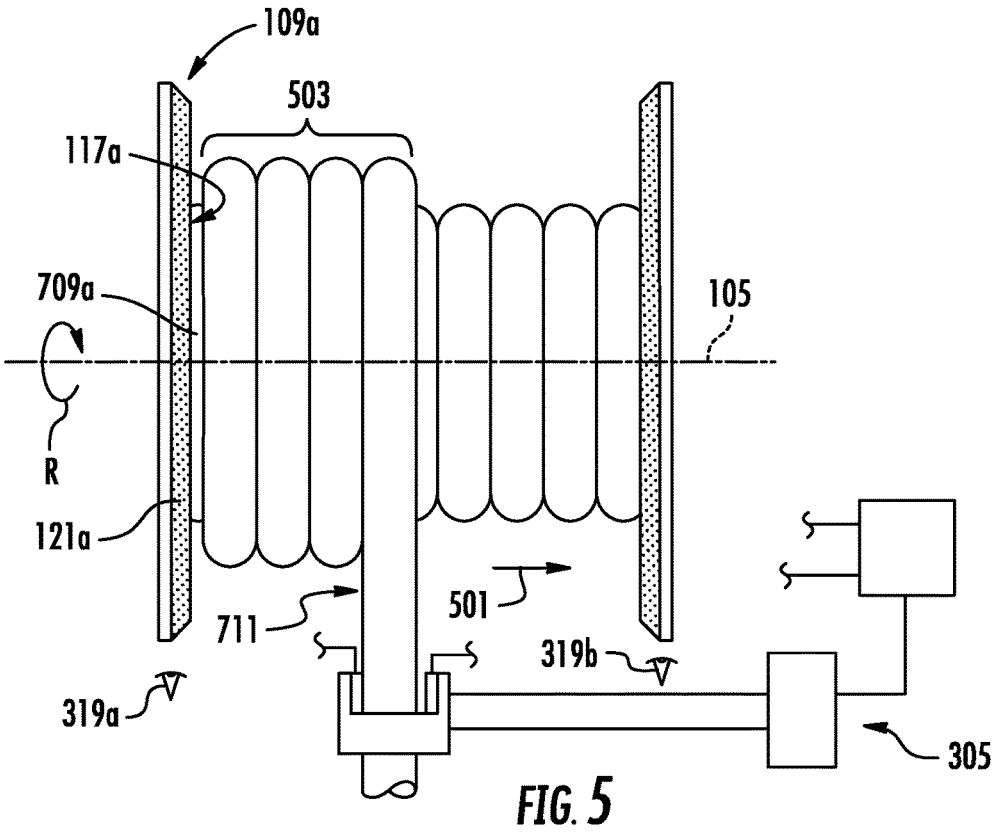
FIG. 5 illustrates the length of cable being still further wound with the winding device in a second axial direction along the central axis opposite the first axial direction to produce a second layer of windings stacked on the first layer of windings.

As shown in FIGS. 3 and 4, the method includes the step of winding the length of cable 711 onto the outer peripheral surface 107 of the drum 103 in a first axial direction 301 along the central axis 105 to produce a first layer 401 of windings. The step of winding may be carried out by rotating the spool 101 about the central axis 105 along rotation direction "R". Optionally, as schematically shown in FIGS. 3-5, the spool apparatus 100 may include a winding device 305. The winding device, in one example, may include an arm 307 that may be extended or retracted by an actuator 309 that may be controlled by a controller 311 programmed such that the controller 311 is configured to operate the actuator 309 to properly wind the length of cable 711 on the spool 101. The winding device 305 can include an effector 315 that, in some examples, may be provided with a first force sensor 313*a* and a second force sensor 313*b*. In operation, the controller may extend the arm 307 along the first axial direction 301 such that the effector 315 follows the length of cable 711 as shown in FIG. 4. Winding can continue until a first end winding reaches a selected position. For instance, the force sensor 313*a* may be designed to send a signal along line 317*a* to the controller 311. As the end winding is increasingly pressed into the layer of conformable material, the force sensor 313*a* sends increasing magnitude force signals to the controller 311. Once the force is of a sufficient magnitude associated with the selected position, the controller causes the actuator 309 to begin retracting the arm such that the cable begins winding in the second axial direction 501 as shown in FIG. 5. As such, the method provides for the first end winding 709*a* of the first layer 401 of windings being sufficiently pressed into the inner face 117*a* of the first flange 109*a* such that the first layer 121*a* of conformable material conforms the inner face 117*a* of the first flange into the shape of a circumferential surface portion 707*a* of the first end winding 709*a*. Then, as discussed above, once the selected position is achieved, winding the cable continues in the second axial direction 501 along the central axis 105 opposite the first axial direction 301 to produce a second layer 503 of windings stacked on the first layer of windings. The second force sensor 313*a* can likewise send a signal along line 317*b* to the controller that can indicate when the selected position is achieved.

As discussed above, the winding device 305 can include force sensors 313*a*, 313*b* to facilitate determining when the selected position is achieved to begin winding in the opposite direction. In addition or alternatively, the winding device 305 may include optical or proximity sensors 319*a*, 319*b* may be provided to help determine when the selected position is achieved. The optical or proximity sensors 319*a*, 319*b* may be placed in operable communication with the controller 311 to facilitate operation of the winding device. Alternative to the winding device, an operator may manually feed the cable and make a visual or other sensory determination as to when the cable has achieved the selected position. The selected position can be the position where the winding of cable can easily drop into a groove between windings of the layer of windings underlying a stacked layer of windings.

Figure 9:
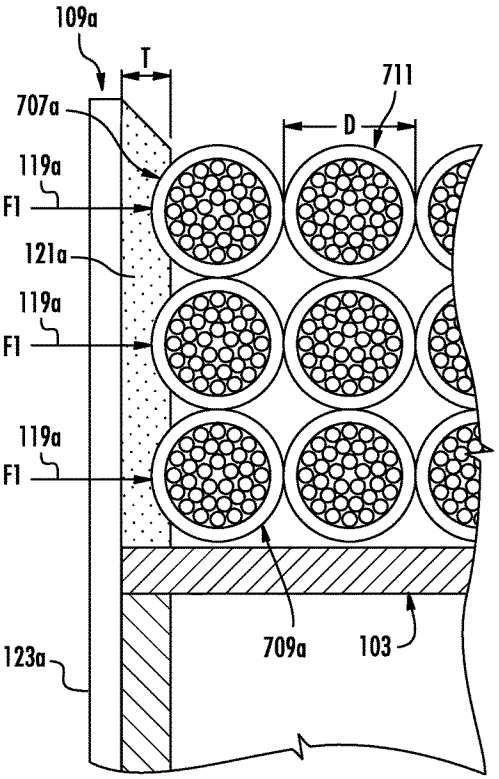
FIG. 9 is an enlarged view of another example stacked configuration wherein the first layer of conformable material of the first flange conforms the inner face of the first flange into a shape of a circumferential surface portion of first end windings of a plurality of stacked layers of windings.

As shown in FIG. 7, the method of winding the cable 711 provides a plurality of stacked layers of windings including the first layer 401 and the second layer 503 of windings. Each layer of stacked windings includes a first end winding 709*a*. The first layer 121*a* of conformable material conforms the inner face 117*a* of the first flange 109*a* into the shape of a circumferential surface portion 707*a* defined by a plurality of first end windings of the plurality of stacked layers of windings in response to the plurality of first end windings pressing against the inner face of the first flange. For example, as shown in FIG. 8, every other first end winding is pressed into the first flange such that the first layer of conformable material conforms to the shape of the circumferential surface portion of every other end winding. Alternatively, as shown in FIG. 9, some of the layers of cables may be stacked in vertically in aligned columns or offset but not fully seated in an underlying groove defined by an underlying layer of windings such that every end winding of each layer of windings of the stack are pressed into the first flange such that the first layer of conformable material conforms to a shape of the circumferential surface portion of every end winding.

Likewise, if provided, the second layer 121*b* of conformable material may also conform to the inner face of the second flange into a shape of a circumferential surface portion of a second end winding of cable stored within the cylindrical storage area in response to the second end winding pressing against the inner face of the second flange.

As shown in FIG. 7, the first layer of conformable material applies the first inner axial force component F1 to the first end winding 709*a* in the first axial direction 119*a* of the central axis 105 while the second layer 121*b* of conformable material applies the second inner axial force component F2 to the second end winding 709*b* in the second axial direction 119*b* of the central axis 105 opposite to the first direction 119*a* such that the first end winding and the second end winding are biased towards one another. As such, in some examples where the first and second end windings are both within the same layer of windings, due to the biasing together of the opposite end portions, the plurality of windings in the layer of windings may be compressed together to provide a compact layer with reduced gaps between the windings and to reduce shifting that may otherwise result in undesired subsequent spacing between the windings of the cable.

The layer of conformable material can also cooperate with the change in direction of winding (e.g., automatic change, manual change, etc.) at the appropriate time when the selected position is achieved. For example, in some embodiments, the length of cable 711 can wind in the first axial direction 301 until the cable presses sufficiently against the inner face 117*a* such that the layer of conformable material gradually conforms the inner face 117*a* to conform to a shape of a circumferential surface portion until a sufficient force is obtained based on sufficient embedding of the end winding 109*a* of cable within the first flange 109*a*. Winding can then manually or automatically continue by winding another layer of windings along the second axial direction 501. The layers can be formed sequentially as the length of cable winds along the first and second axial directions 301, 501.

Figure 6:
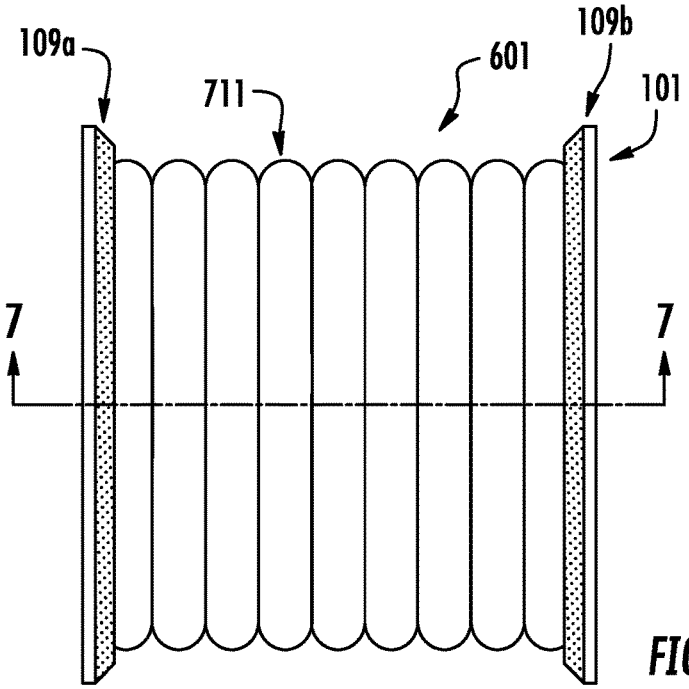
FIG. 6 illustrates a spool of wound cable including the length of cable being wound on the spool of FIG. 1.

Once the method of winding is complete, a spool apparatus of wound cable 601 is provided as shown in FIGS. 6 and 7. As shown, the length of cable is wound within the cylindrical storage area 115 to include at least one layer of windings extending between the first flange 109*a* and the second flange 109*b*. As discussed above, each layer of windings (e.g., see layers 401 and 503) includes a first end winding 709*a*. As discussed previously, the first layer 121*a* of conformable material is configured to conform the inner face of the first flange 109*a* into the shape of the circumferential surface portion 707*a* of at least one first end winding of the at least one layer of windings in response to the at least one first end winding being pressed against the inner face of the first flange. As shown in FIG. 8, the first layer of conformable material may be configured to conform to the inner face of the first flange to the shape of the circumferential surface portion of every other end winding in the stack of end windings. Alternatively, as shown in FIG. 9, the first layer of conformable material may be configured to conform to the inner face of the first flange to the shape of the circumferential surface portion of every winding in the stack of windings.

As such, the at least one layer of windings can include a plurality of stacked layers of windings such as the second layer 503 of windings stacked on the first layer 401 of windings shown in FIG. 7. Moreover, the first layer of conformable material may conform the inner face of the first flange into a shape of the circumferential surface portion defined by a plurality of first end windings of the plurality of stacked layers of windings in response to the plurality of first end windings being pressed against the inner face of the first flange. As shown in FIG. 8, only some end windings (e.g., from every other stacked layer of windings) may be pressed into the inner face of the first flange. Alternatively, as shown in FIG. 9 all of the end windings (e.g., from every stacked layer of windings) may be pressed into the inner face of the first flange.

The conformable layer of material can allow embedding of end windings with in the flanges to help properly seat the layers of cable in a compact fashion. Indeed, due to the resiliency of the conformable layer, lateral forces may be applied resulting from the elasticity of the material attempting to at least partially return to its or original shape to help compress the windings together to eliminate unwanted gaps between the windings of cable. Moreover, interaction with the conformable material layer can allow the winding device to automatically reverse direction of the cable to provide well defined layers of windings. As shown in FIG. 3, the layer of conformable material may optionally include an outer peripheral inner edge with an outer beveled portion 303 to help reduce stress points and help prevent the cable from riding up and over the flange. Still further, the conformable material may allow the spool apparatus to be used with various diameters of cable while still providing well-formed layers of cable windings that are efficiently stacked one over the other. Indeed, without the conformable layer, the width "W" shown in FIG. 3 would be rigidly set to the distance between the inner major surfaces 127*a*, 127*b* of the respective first and second layers 123*a*, 123*b* of substantially rigid material. As such, to ensure a snug fit between the outer most portions of the end windings, the width "W" would need to equal substantially a multiple of the outer diameter of the cable. Otherwise, there would be an unfortunate gap between one or both of the outer windings and the respective flanges, resulting in play within the layer of windings that may result in inefficient winding of cable. However, the layer of conformable material can allow the inner face to conform to the shape of the circumferential surface portion of the cable to accommodate for gaps that may otherwise exist between the inner major surfaces of the layers or substantially rigid material.

Still further, in one example, as shown in FIG. 8, the length of cable includes a diameter "D" taken along a cross-section substantially perpendicular to an elongated axis of the cable 711, wherein the first layer 121*a* of conformable material includes a thickness "T" defined between the outer surface 129*a* of the first layer of conformable material and the inner face 117*a* of the first flange 109*a*. In some examples, the thickness "T" of the first layer 121*a* of conformable material is less than or equal to about 70% of the diameter of the cable 711, such as from about 50% to about 70% of the diameter of the cable 711. Likewise, in some examples, a thickness of the second layer 121*b* of conformable material can be less than or equal to about 70% of the diameter of the cable 711, such as from about 50% to about 70% of the diameter of the cable 711. Providing a thickness "T" of less than or equal to 70% of the diameter of the cable 711, such as from about 50% to about 70% of the diameter of the cable 711, has been found, in some embodiments, to result in sufficient support of the layer of conformable material to prevent the end windings from embedding too far into the corresponding flanges.

Providing the first flange and the second flange with the layer of conformable material can help efficiently wind cable of various diameters on a common spool. As such, a single spool may be provided for successfully winding a wide range of cable diameters. Indeed, the cable may wind and the conformable material may deflect sufficiently such that a desired number of windings is achieved along the layer of windings. As such, the spool may accommodate slight variations in length of the winding layer depending on the diameter of the cable such that the optimal length is achieved by an integer number of cable windings. Moreover, the layer of conformable material can help mend any inconsistencies in optimal flange configurations that may otherwise be compromised by wear and tear on the flanges. Indeed, conventional substantially rigid flanges may become dented or otherwise damaged that may interfere with optimal winding of the cable. However, the layer of conformable material can help mend any damage to the flanges as an optimal winding can still be achieved due to the elasticity of the conformable material. As such, the layer of conformable material can help address configurations where flanges are not square azimuthally and radially relative to the drum and/or dented and damaged that may otherwise create non-regular widths between the flanges. Winding procedures can be improved by providing a construction that overcomes the shortcomings of flange rigidness and non-uniformity as well as varied cable diameter by allowing each winding of a stacked layer of windings to be properly seated within a corresponding underlying groove defined between windings of the underlying layer of windings.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

What is claimed is:

1. A spool apparatus configured to wind a length of cable, the spool apparatus comprising:

a drum extending along a central axis of the spool apparatus;

a first flange mounted with respect to a first axial end portion of the drum, the first flange including a first layer of conformable material defining an inner face of the first flange; and a second flange mounted with respect to a second axial end portion of the drum, the second flange including a second layer of conformable material defining an inner face of the second flange, wherein a cylindrical storage area is defined between the inner face of the first flange, the inner face of the second flange and an outer peripheral surface of the drum, wherein the first layer of conformable material is configured to conform the inner face of the first flange into a shape of a circumferential surface portion of a first end winding of cable wound within the cylindrical storage area in response to the first end winding of cable being pressed against the inner face of the first flange, and wherein the second layer of conformable material is configured to conform the inner face of the second flange into a shape of a circumferential surface portion of a second end winding of cable wound within the cylindrical storage area in response to the second end winding of cable being pressed against the inner face of the second flange;

wherein each layer of conformable material has a compression deflection of 25% within a range of from about 34 kPa to about 345 kPa.

2. The spool apparatus of claim 1, wherein the first layer of conformable material is configured to apply an inner axial force component to the first end winding of cable in a first direction of the central axis, and the second layer of conformable material is configured to apply an inner axial force component to the second end winding in second axial direction of the central axis that is opposite to the first axial direction.

3. The spool apparatus of claim 1, wherein each layer of conformable material is substantially resilient.

4. The spool apparatus of claim 1, wherein an outer peripheral inner edge of the conformable material comprises an outer beveled portion.

5. The spool apparatus of claim 1, wherein the first flange comprises a first layer of substantially rigid material supporting the first layer of conformable material and the second flange comprises a second layer of substantially rigid material supporting the second layer of conformable material.

6. The spool apparatus of claim 5, wherein each layer of substantially rigid material includes an inner major surface facing an inward direction toward the cylindrical storage area, the first layer of conformable material includes an outer surface mounted to the inner major surface of the first layer of substantially rigid material, and the second layer of conformable material includes an outer surface mounted to the inner major surface of the second layer of substantially rigid material.

7. The spool apparatus of claim 1 coupled to a winding device configured to permit winding of the length of cable on the outer peripheral surface of the drum in a first axial direction along the central axis to produce a first layer of windings, and further configured to cause the length of cable to begin winding in a second axial direction to produce a second layer of windings stacked on the first layer of windings in response to a first end winding of the first layer of windings reaching a selected position.

8. The spool apparatus of claim 7, wherein the winding device comprises a sensor configured to determine when the first end winding of the first layer of windings reaches the selected position.

9. A spool of wound cable comprising:

a drum extending along a central axis of the spool of wound cable;

a first flange mounted with respect to a first axial end portion of the drum, the first flange including a first layer of conformable material defining an inner face of the first flange;

a second flange mounted with respect to a second axial end portion of the drum, the second flange including a second layer of conformable material defining an inner face of the second flange, wherein a cylindrical storage area is defined between the inner face of the first flange, the inner face of the second flange and an outer peripheral surface of the drum; and a length of cable wound within the cylindrical storage area to include at least one layer of windings extending between the first flange and the second flange, wherein each layer of windings includes a first end winding with the first layer of conformable material conforming the inner face of the first flange into a shape of a circumferential surface portion of at least one first end winding of the at least one layer of windings in response to the at least one first end winding being pressed against the inner face of the first flange, and wherein each layer of windings includes a second end winding with the second layer of conformable material conforming the inner face of the second flange into a shape of a circumferential surface portion of at least one second end winding of the at least one layer of windings in response to the at least one second end winding being pressed against the inner face of the second flange.

10. The spool of wound cable of claim 9, wherein the at least one layer of windings includes a plurality of stacked layers of windings with the first layer of conformable material conforming the inner face of the first flange into the shape of the circumferential surface portion of a plurality of first end windings of the plurality of stacked layers of windings in response to the plurality of first end windings being pressed against the inner face of the first flange, and the second layer of conformable material conforming the inner face of the second flange into the shape of the circumferential surface portion of a plurality of second end windings of the plurality of stacked layers of windings in response to the plurality of second end windings being pressed against the inner face of the second flange.

11. The spool of wound cable of claim 10, wherein the first layer of conformable material applies a first inner axial force component to the at least one first end winding in a first direction of the central axis while the second layer of conformable material applies a second inner axial force component to the at least one second end winding in a second direction of the central axis opposite to the first direction such that the at least one first end winding and the at least one second end winding are biased towards one another.

12. The spool of wound cable of claim 10, wherein the first flange comprises a first layer of substantially rigid material supporting the first layer of conformable material and the second flange comprises a second layer of substantially rigid material supporting the second layer of conformable material.

13. The spool of wound cable of claim 12, wherein the first layer of substantially rigid material includes an inner major surface facing the cylindrical storage area, and the first layer of conformable material includes an outer surface mounted to the inner major surface, and the second layer of substantially rigid material includes an inner major surface facing the cylindrical storage area, and the second layer of conformable material includes an outer surface mounted to the inner major surface.

14. The spool of wound cable of claim 13, wherein the length of cable includes a diameter taken along a cross-section substantially perpendicular to an elongated axis of the cable, each layer of conformable material includes a thickness defined between the outer surface of the corresponding layer of conformable material and the inner face of the first flange, and the thickness of each layer of conformable material is less than or equal to about 70% of the diameter of the cable.

15. The spool of wound cable of claim 9, wherein a thickness of the first layer of conformable material measured in the direction of the central axis is less than or equal to 70% of a diameter of the wound cable, wherein a thickness of the second layer of conformable material measured in the direction of the central axis is less than or equal to 70% of a diameter of the wound cable.

16. A method of winding a length of cable comprising the steps of:

winding the length of cable onto an outer peripheral surface of a drum of a spool in a first axial direction to produce a first layer of windings, wherein winding the cable in the first axial direction continues to a selected position where a first end winding of the first layer of windings is pressed into an inner face of a first flange of the spool such that a first layer of conformable material of the first flange conforms the inner face of the first flange into a shape of a circumferential surface portion of the first end winding; and then winding the length of cable in a second axial direction opposite the first axial direction to produce a second layer of windings stacked on the first layer of windings.

17. The method of claim 16, wherein the step of winding the cable provides a plurality of stacked layers of windings including the first layer and the second layer of windings, and wherein each layer of stacked windings includes a first end winding, and the first layer of conformable material conforms the inner face of the first flange into a shape of the circumferential surface portion defined by a plurality of first end windings of the plurality of stacked layers of windings in response to the plurality of first end windings pressing against the inner face of the first flange, and wherein each layer of stacked windings includes a second end winding, and a second layer of conformable material of a second flange of the spool conforms an inner face of the second flange into a shape of the circumferential surface portion defined by a plurality of second end windings of the plurality of stacked layers of windings in response to the plurality of second end windings pressing against the inner face of the second flange.

18. The method of claim 17, wherein the first layer of conformable material applies a first inner axial force component to each of the plurality of first end windings in a first axial direction while the second layer of conformable material applies a second inner axial force component to each of the plurality of second end windings in a second axial direction opposite to the first axial direction.

19. The method of claim 16, further comprising the step of operating a winding device to begin winding the length of cable in the second axial direction once the first layer of windings reaches the selected position.

20. The method of claim 19, further comprising the step of determining the selected position based on feedback from the winding device.

* * * * *